US009433303B2

(12) United States Patent
Zhong

(10) Patent No.: US 9,433,303 B2
(45) Date of Patent: Sep. 6, 2016

(54) INFANT CHAIR APPARATUS

(71) Applicant: Wonderland Nurserygoods Company Limited, Kwai Chung, N. T. (HK)

(72) Inventor: Zhi-Ren Zhong, Kwai Chung (HK)

(73) Assignee: Wonderland Nurserygoods Company, Ltd., Hong Kong (HK)

( * ) Notice: Subject to any disclaimer, the term of this patent is extended or adjusted under 35 U.S.C. 154(b) by 0 days.

(21) Appl. No.: 14/621,468

(22) Filed: Feb. 13, 2015

(65) Prior Publication Data

US 2015/0245719 A1 Sep. 3, 2015

(30) Foreign Application Priority Data

Feb. 17, 2014 (CN) ..... 2014 1 0053165

(51) Int. Cl.
*A47C 3/02* (2006.01)
*A47D 13/10* (2006.01)

(52) U.S. Cl.
CPC ..... *A47D 13/105* (2013.01); *A47D 13/10* (2013.01)

(58) Field of Classification Search
CPC ..... A47D 13/105; A47D 13/10
USPC ..... 297/260.2, 259.4, 261.1, 261.4, 258.1
See application file for complete search history.

(56) References Cited

U.S. PATENT DOCUMENTS 4,598,946 A * 7/1986 Cone ..... A47D 13/107 297/258.1
5,575,530 A * 11/1996 Harper ..... A47D 13/107 297/183.2
5,660,430 A * 8/1997 Clarke ..... A47D 9/02 297/130
7,073,859 B1 * 7/2006 Wilson ..... B60N 2/0232 297/250.1
7,485,086 B2 * 2/2009 Dickie ..... A47D 9/02 600/28
7,717,798 B2 * 5/2010 Bellows ..... A47D 13/10 472/36
7,722,118 B2 * 5/2010 Bapst ..... A47D 9/02 297/256.12
7,845,728 B2 * 12/2010 Chen ..... A47D 13/10 297/260.1
7,862,118 B2 * 1/2011 Sims, Jr. ..... A47D 13/10 297/260.2
7,958,579 B2 * 6/2011 Westerkamp ..... A47D 9/02 5/105
8,047,609 B2 * 11/2011 Chen ..... A47D 13/10 297/260.1
8,197,005 B2 * 6/2012 Hopke ..... A47C 1/00 297/260.2
8,690,245 B2 * 4/2014 Tuckey ..... A47D 13/105 297/260.2
9,033,415 B2 * 5/2015 Hopke ..... A47D 9/02 297/260.2

(Continued)

FOREIGN PATENT DOCUMENTS

CN 202891272 U 4/2013

OTHER PUBLICATIONS

Official Action from European Patent Application No. 15155005.0 dated Jun. 30, 2015.

*Primary Examiner* — Jose V Chen
(74) *Attorney, Agent, or Firm* — Baker & McKenzie LLP

(57) ABSTRACT

An infant chair apparatus includes a support base, a movable platform assembled with the support base for sliding movement, a seat portion arranged above the support base and pivotally connected with the movable platform, a rotation drive mechanism operable to drive reciprocated rotation of the seat portion relative to the support base, and a sliding drive mechanism operable to drive the movable platform to slide relative to the support base.

21 Claims, 14 Drawing Sheets

(56) References Cited

U.S. PATENT DOCUMENTS

| | | | | |
|---|---|---|---|---|
| 9,155,403 | B2 * | 10/2015 | Mountz | A47D 13/105 |
| 2007/0205646 | A1 | 9/2007 | Bapst et al. | |
| 2008/0179928 | A1 | 7/2008 | Chen et al. | |
| 2010/0052376 | A1 | 3/2010 | Hopke et al. | |
| 2013/0026805 | A1 * | 1/2013 | Sclare | A47D 13/105 297/260.2 |
| 2013/0229040 | A1 * | 9/2013 | Mountz | A47C 9/02 297/260.2 |
| 2015/0196137 | A1 * | 7/2015 | Zhao | A47D 13/105 297/260.2 |
| 2015/0250330 | A1 * | 9/2015 | Mountz | A47D 13/105 297/183.4 |
| 2015/0265068 | A1 * | 9/2015 | Ferraro | A47D 13/105 472/118 |

* cited by examiner

INFANT CHAIR APPARATUS

CROSS-REFERENCE TO RELATED APPLICATION(S)

This U.S. Patent Application claims priority to China Patent Application No. 201410053165.5 filed on Feb. 17, 2014, which is incorporated herein by reference.

BACKGROUND

1. Field of the Invention

The present invention relates to infant chair apparatuses.

2. Description of the Related Art

Infant swing apparatuses have become common household items. An infant swing has the primary function of applying a gentle, swinging or gliding motion to soothe a child, while providing a safe and comfortable seating area. However, one main drawback of the current infant swings is that they are generally built with large standing frames and swing arms that are complicated to fold or disassemble. This makes travelling with an infant swing all the more difficult. Moreover, most conventional swings perform a pendulum motion that displaces the child vertically, which may cause sickness for certain children.

Therefore, there is a need for an apparatus for soothing a child that is more convenient in use, and can address at least the foregoing issues.

SUMMARY

The present application describes an infant chair apparatus that includes a support base, a movable platform assembled with the support base for sliding movement, a seat portion arranged above the support base and pivotally connected with the movable platform, a rotation drive mechanism operable to drive reciprocated rotation of the seat portion relative to the support base, and a sliding drive mechanism operable to drive the movable platform to slide relative to the support base.

DETAILED DESCRIPTION OF THE EMBODIMENTS

Figure 3:
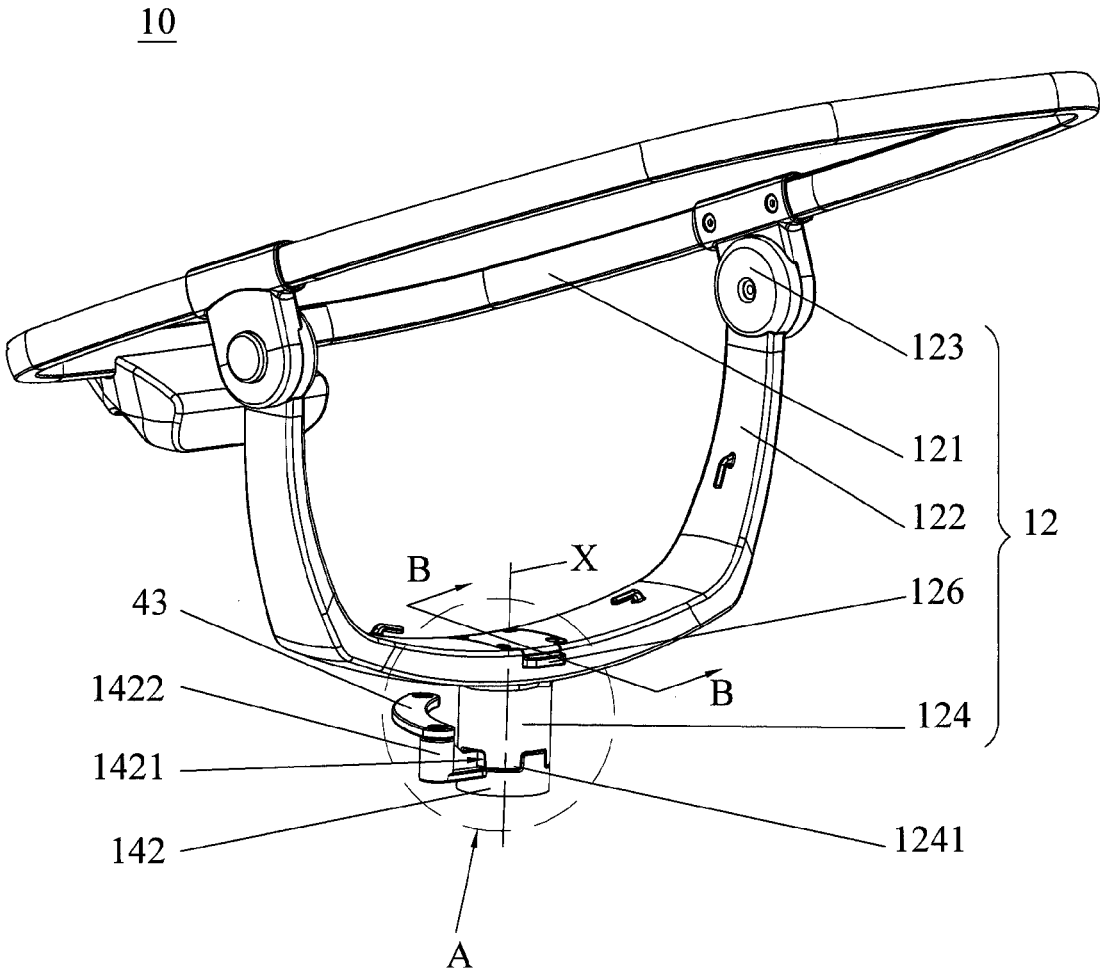
FIG. 3 is a schematic view illustrating the assembly of a seat frame with a coupling mount in the infant chair apparatus of FIG. 1.
Figure 4:
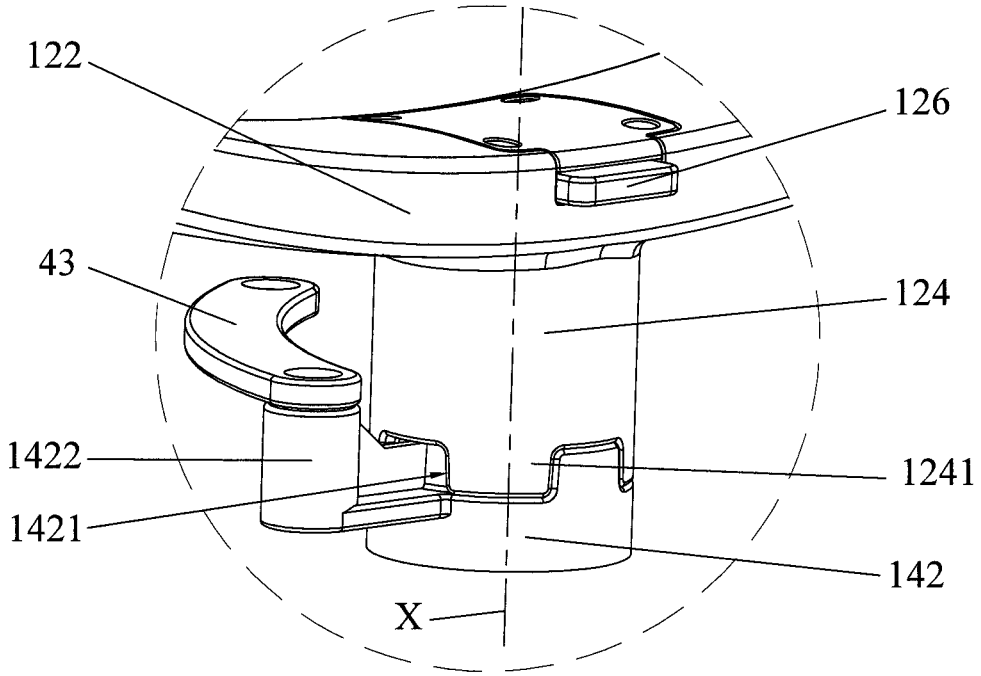
FIG. 4 is an enlarged view illustrating portion A shown in FIG. 3.
Figure 5:
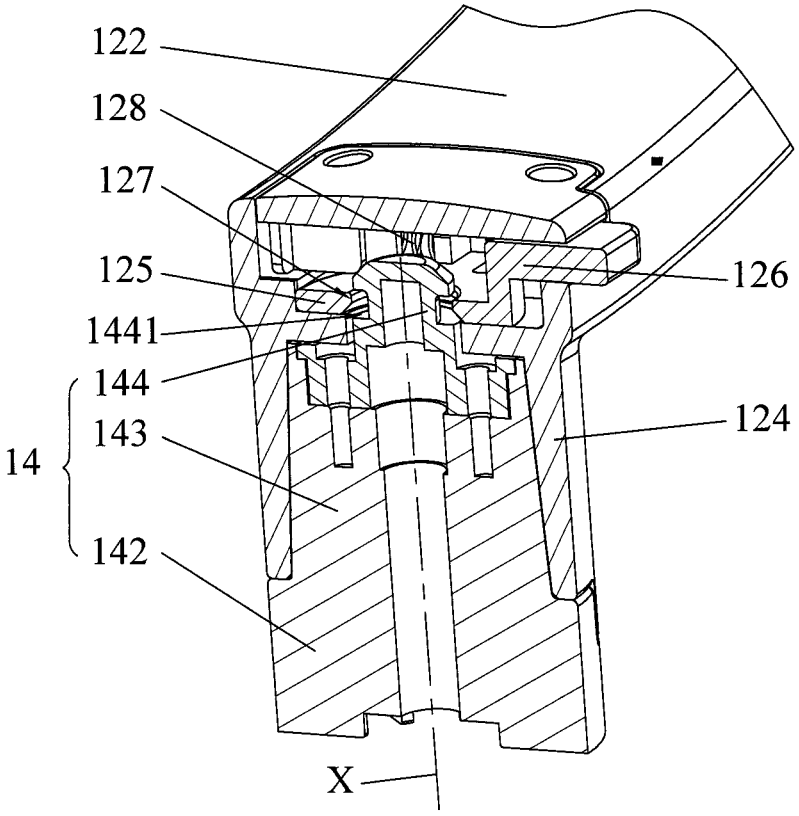
FIG. 5 is a cross-sectional view taken along section B shown in FIG. 3.

FIGS. 1-8 are schematic views illustrating an embodiment of an infant chair apparatus 1. The infant chair apparatus 1 can include a seat portion 10, a support base 30, and a movable platform 20 that is slidably assembled with the support base 30 and pivotally connected with the seat portion 10. Referring to FIGS. 3-5, the movable platform 20 can include an axle 141 (better shown in FIGS. 6 and 7) and a coupling mount 14. The axle 141 is affixed with the mount platform 20, and extends upright to define a pivot axis X about which the coupling mount 14 is pivotally connected with the movable platform 20. The pivot axis X defined by the axle 141 can be substantially vertical, i.e., it can be vertical or slightly inclined relative to a vertical axis.

The seat portion 10 can include a seat frame 12, and a fabric member (not shown) affixed with the seat frame 12 to provide comfortable resting support to a child. The seat frame 12 can fasten to the coupling mount 14 at a position vertically above the axle 141, and can be detached from the coupling mount 14 for removal of the seat portion 10 from the support base 30. When they are fixedly connected with each other, the seat frame 12 and the coupling mount 14 can rotate in unison about the axle 141 relative to the movable platform 20. When the seat portion 10 is removed from the support base 30, the coupling mount 14 remains assembled with the axle 141 of the support base 30.

The seat frame 12 can include a surrounding frame portion 121 having an elongated and closed shape, and a support frame portion 122 having a U-shape. The support frame 122 is arranged under the surrounding frame portion 121, and can have two upper ends respectively affixed with a left and a right side of the surrounding frame portion 121. The surrounding frame portion 121 and the support frame portion 122 can define a space for receiving a child. In one embodiment, the two upper ends of the support frame portion 122 can be respectively connected with the surrounding frame portion 121 via two hinges 123. When the infant chair apparatus 1 is unused, the surrounding frame portion 121 can be rotated about the hinges 123 to collapse the surrounding frame portion 121 toward the support frame portion 122 for reducing the volume of the seat frame 12.

Referring again to FIGS. 3-5, the coupling mount 14 of the support base 30 can be detachably connected with the seat frame 12. The coupling mount 14 can include a stem 143 extending upright and having a lower portion 142 of an enlarged shape. The stem 143 and its lower portion 142 can be formed integrally as a single body. An underside of the support frame portion 122 can be affixed with a sleeve 124 that projects downward and has an interior where the stem 143 can be at least partially received. A lower rim of the sleeve 124 can be formed with one or more flanges 1241 protruding downward, and the lower portion 142 of the stem 143 can have one or more slots 1421 into which the flanges 1241 can respectively engage. In one embodiment, the flanges 1241 can be uniformly distributed along the lower rim of the sleeve 124. The engagement of the flanges 1241 with the slots 1421 can rotationally lock the coupling mount 14 with the seat frame 12, such that the seat frame 12 and the coupling mount 14 can rotate in unison about the axle 141.

An upper end of the stem 143 can be formed with a stud 144 that can insert into the support frame portion 122 of the seat frame 12. More specifically, the stud 144 can extend upward from the stem 143, and can have an outer surface formed with an annular recess 1441. The support frame portion 122 can include a latch 125, and a release actuator 126 exposed outward for manual operation. The latch 125 can be provided with an opening 127 for the passage of the stud 144, and can be connected with the release actuator 126. In one embodiment, the release actuator 126 may be formed integrally with the latch 125. Both the latch 125 and the release actuator 126 may be operable to slide in a plane substantially perpendicular to the pivot axis X of the seat portion 10. Moreover, a spring 128 can be respectively connected with the release actuator 126 and the support frame portion 122.

The latch 125 can be movable radially relative to the pivot axis X of the seat portion 10 between a locking state and an unlocking state. In the locking state, a rim of the opening 127 in the latch 125 can engage with the annular recess 1441 of the stud 144 for attaching the seat portion 10 with the stem 143 of the coupling mount 14. In the unlocking state, the rim of the opening 127 in the latch 125 can disengage from the annular recess 1441 of the stud 144 for detachment of the seat portion 10 from the stem 143. The spring 128 can bias the release actuator 126 and the latch 125 to the locking state, and the release actuator 126 is operable to move the latch 125 from the locking state to the unlocking state.

Figure 1:
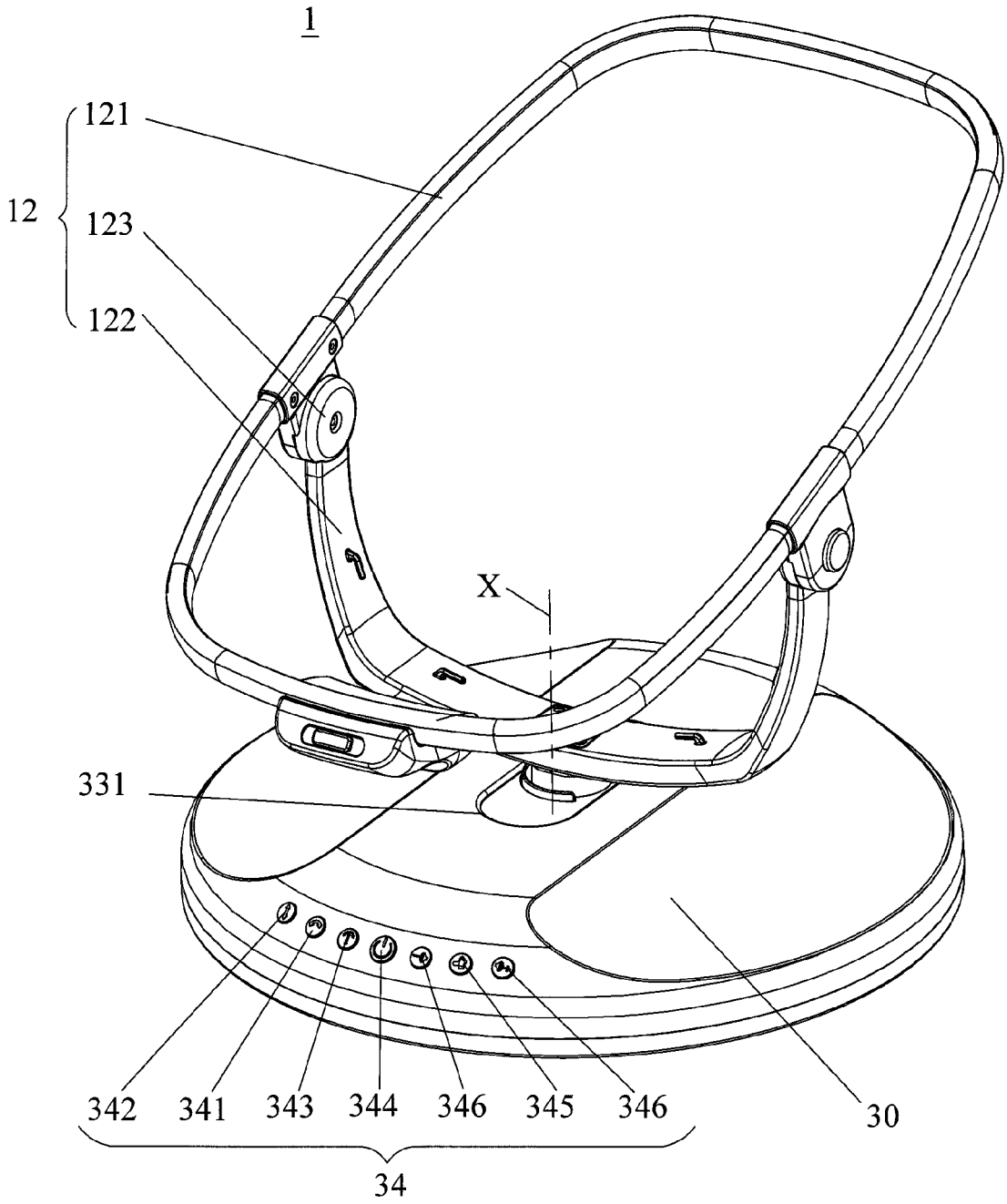
FIG. 1 is a perspective view illustrating an embodiment of an infant chair apparatus.
Figure 2:
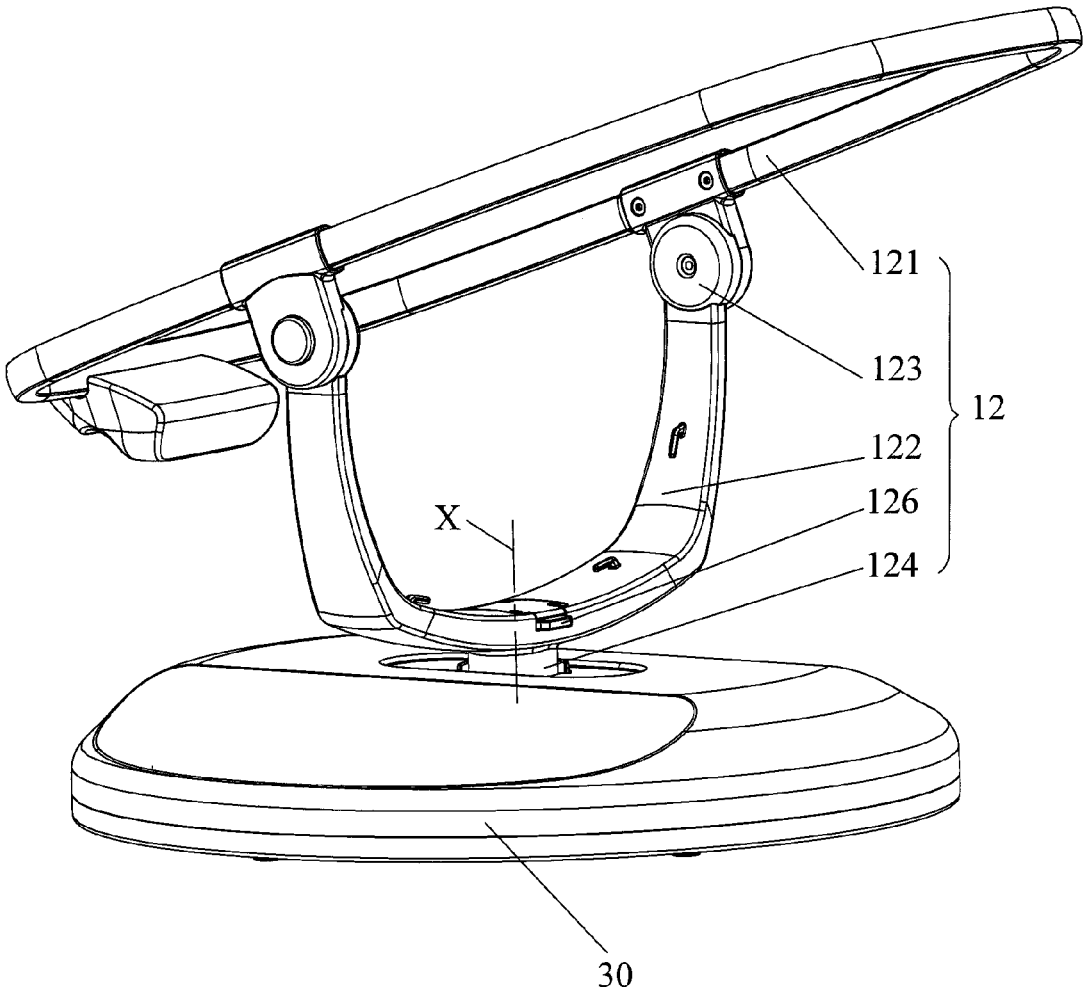
FIG. 2 is a perspective view illustrating the infant chair apparatus of FIG. 1 under another angle of view.

When the seat frame 12 is installed on the support base 30, the surrounding frame portion 121 is unfolded relative to the support frame portion 122 as shown in FIG. 1. The seat frame 12 is placed such that the stem 143 is received in the sleeve 124 and the flanges 1241 respectively engage into the slots 1421. Moreover, the stud 144 can be arranged through the opening 127, and the spring 128 can bias the latch 125 so that the rim of the opening 127 can engage with the annular recess 1441. The seat frame 12 can be thereby fastened to the coupling mount 14 of the support base 30 at a position vertically above the axle 141. It is worth noting that the shape of the annular recess 1441 extending around the axle 141 can accommodate the engagement of the latch 125 in different radial positions relative to the pivot axis X, which allows convenient installation of the seat frame 12 in different horizontal orientation.

When the infant chair apparatus 1 is not used, the release actuator 126 can be depressed against the biasing action of the spring 128 to disengage the latch 125 from the annular recess 1441. The seat frame 12 then can be lifted and separated from the coupling mount 14 that remains coupled with the support base 30. The surrounding frame portion 121 then can be rotated about the hinges 123 to collapse toward the support frame portion 122, which reduces the volume of the seat frame 12 and facilitates its storage and portability.

Referring to FIGS. 8-14, the infant chair apparatus 1 can further include a rotation mechanism 40 and a sliding drive mechanism 50. The rotation mechanism 40 can drive the seat portion 10 to rotate alternately to the left and right side in a reciprocated manner about the pivot axis X, whereas the sliding drive mechanism 50 can be operable to drive the movable platform 20 and the seat portion 10 carried thereon to slide back and forth in a reciprocated manner along a substantially horizontal plane that is substantially perpendicular to the pivot axis X.

The rotation drive mechanism 40 can include a crank 41, an electric motor 42 and a linking rod 43. The crank 41 can have a first end affixed with a rotary shaft 441. The linking rod 43 can have a first end pivotally connected with the crank 41, and a second end pivotally connected with the lower portion 142 of the stem 143 at a location eccentric from the pivot axis. For example, the lower portion 142 of the stem 143 can have an outward radial extension 1422, and the linking rod 43 can be pivotally connected with the outward radial extension 1422. The electric motor 42 is carried by the movable platform 20, and is coupled with the rotary shaft 441 of the crank 41.

The electric motor 42 can be operable to drive the crank 41 in rotation, which in turn can drive the linking rod 43 in movement to cause the coupling mount 14 (including the stem 143 and its lower portion 142) and the seat portion 10 to perform an oscillating movement by rotating about the axle 141 in a reciprocated manner. The angular range in which the seat portion 10 can oscillate can be set by the respective lengths of the crank 41 and the linking rod 43. In one embodiment, this angular range can be about 20 degrees to about 80 degrees. For example, the angular range of oscillation of the seat portion 10 can be 60 degrees, i.e., the seat portion 10 can rotate 30 degrees to each of a left and a right side of a center position.

Figure 14:
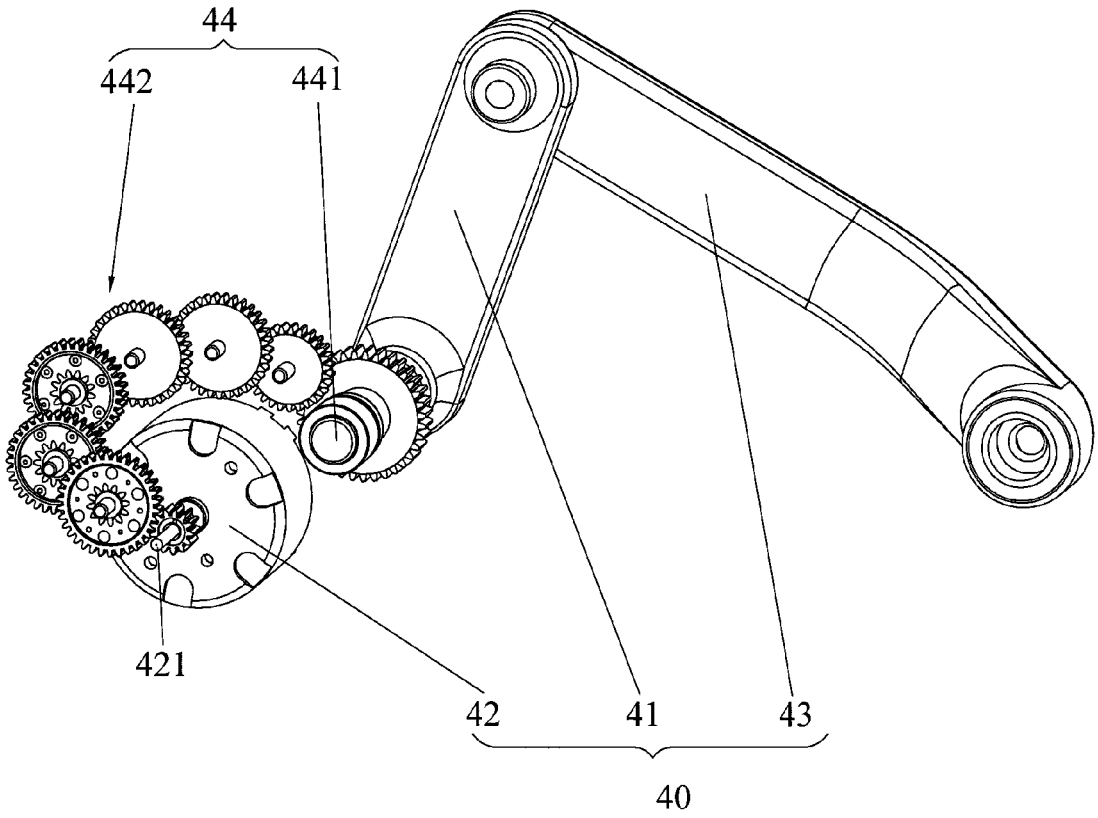
FIG. 14 is a schematic view illustrating a speed reduction mechanism implemented in the rotation drive mechanism.

Referring to FIG. 14, a speed reduction mechanism 44 can be arranged between the electric motor 42 and the rotary shaft 441 of the crank 41. The speed reduction mechanism 44 can transmit and reduce the rotational speed outputted by the electric motor 42 before it is applied to the rotary shaft 441 of the crank 41, so that the seat portion 10 can oscillate at a proper speed and frequency. In one embodiment, the speed reduction mechanism 44 can include a train of transmission gears 442 arranged between the rotary shaft 441 and the output shaft 421 of the electric motor 42.

Figure 10:
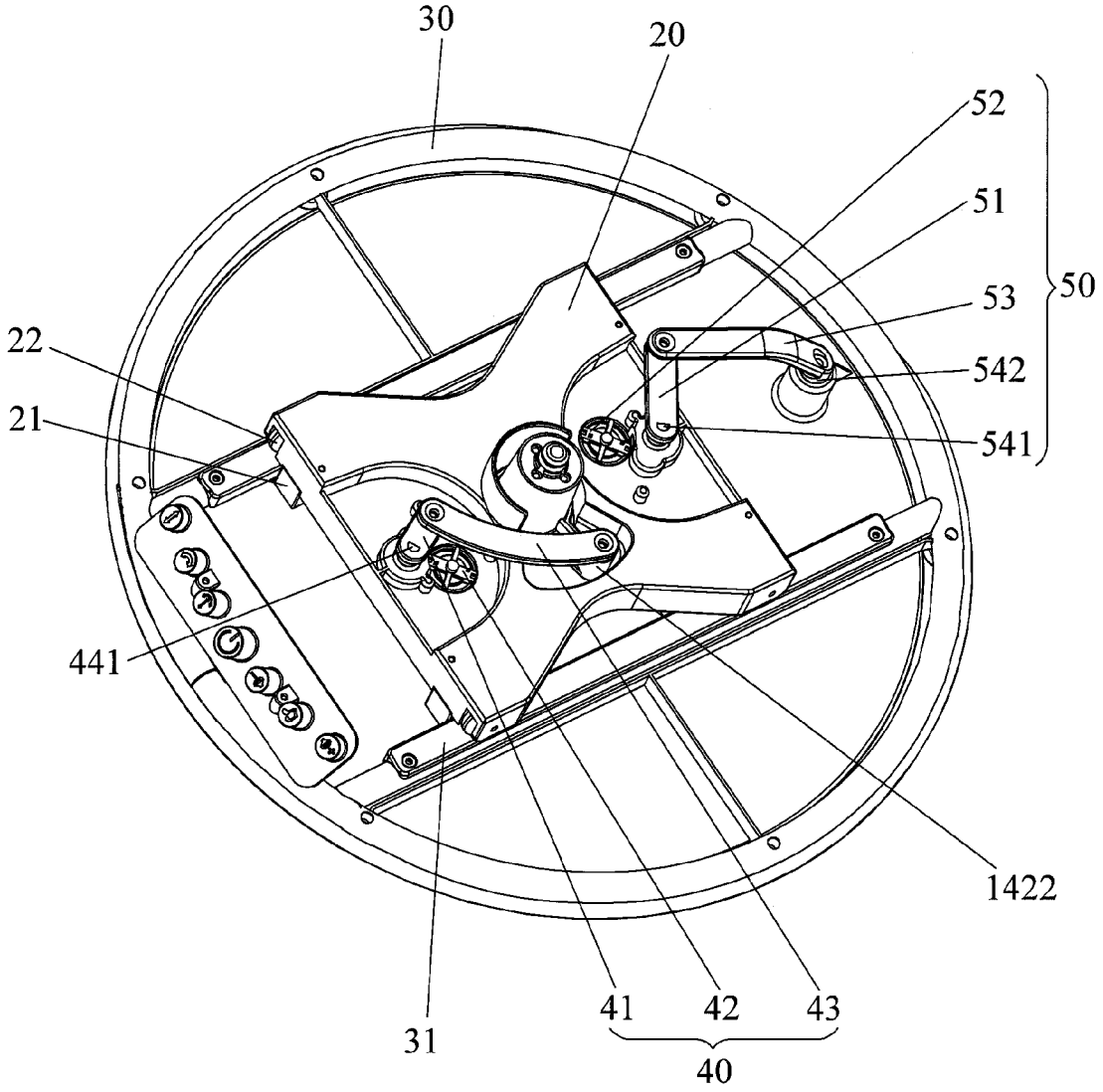
Figure 11:
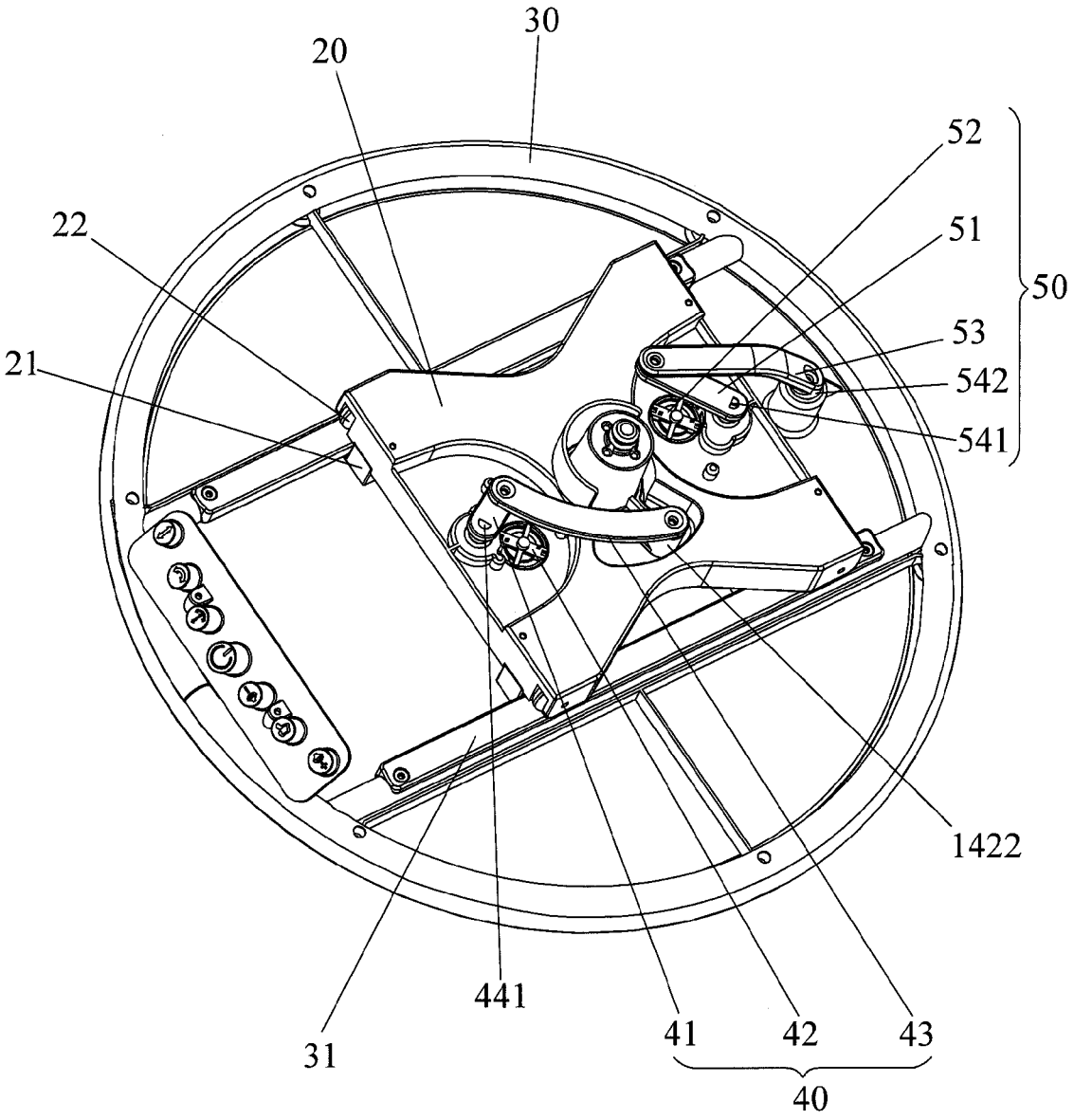

Referring to FIGS. 10 and 11, the sliding drive mechanism 50 can include two parallel rails 31, a crank 51, an electric motor 52 and a linking rod 53. The two parallel rails 31 extend along a direction from a rear to a front of the seat portion 10, and are affixed with the support base 30. The two rails 31 can define a plane substantially horizontal along which the movable platform 20 can slide relative to the support base 30. The movable platform 20 can have a plurality of wheels 22 in rolling contact with the rails 31 to facilitate the displacement of the movable platform 20 along the rails 31. In one embodiment, the movable platform 20 can be exemplary provided with 4 wheels that are respectively distributed at a left and a right side of the movable platform 20. The movable platform 20 can further include a plurality of retaining arms 21 that extend underneath the rails 31 to prevent separation of the movable platform 20 from the support base 30.

The crank 51 can have a first end affixed with a rotary shaft 541. The linking rod 53 can have two opposite ends respectively connected pivotally with a second end of the crank 51 and an anchor point 542 affixed with the support base 30. The electric motor 52 can be carried by the movable platform 20, and can be coupled with the rotary shaft 541 of the crank 51. Like previously described, a speed reduction mechanism 54 comprised of transmission gears can be arranged between the electric motor 52 and the rotary shaft 541 of the crank 51.

The electric motor 52 can be operable to drive the crank 51 in rotation, which in turn can urge the linking rod 53 in movement to drive the movable platform 20, the coupling mount 14 and the seat portion 10 carried on the movable platform 20 to slide back and forth in a reciprocated manner along the rails 31 relative to the support base 30.

Figure 12:
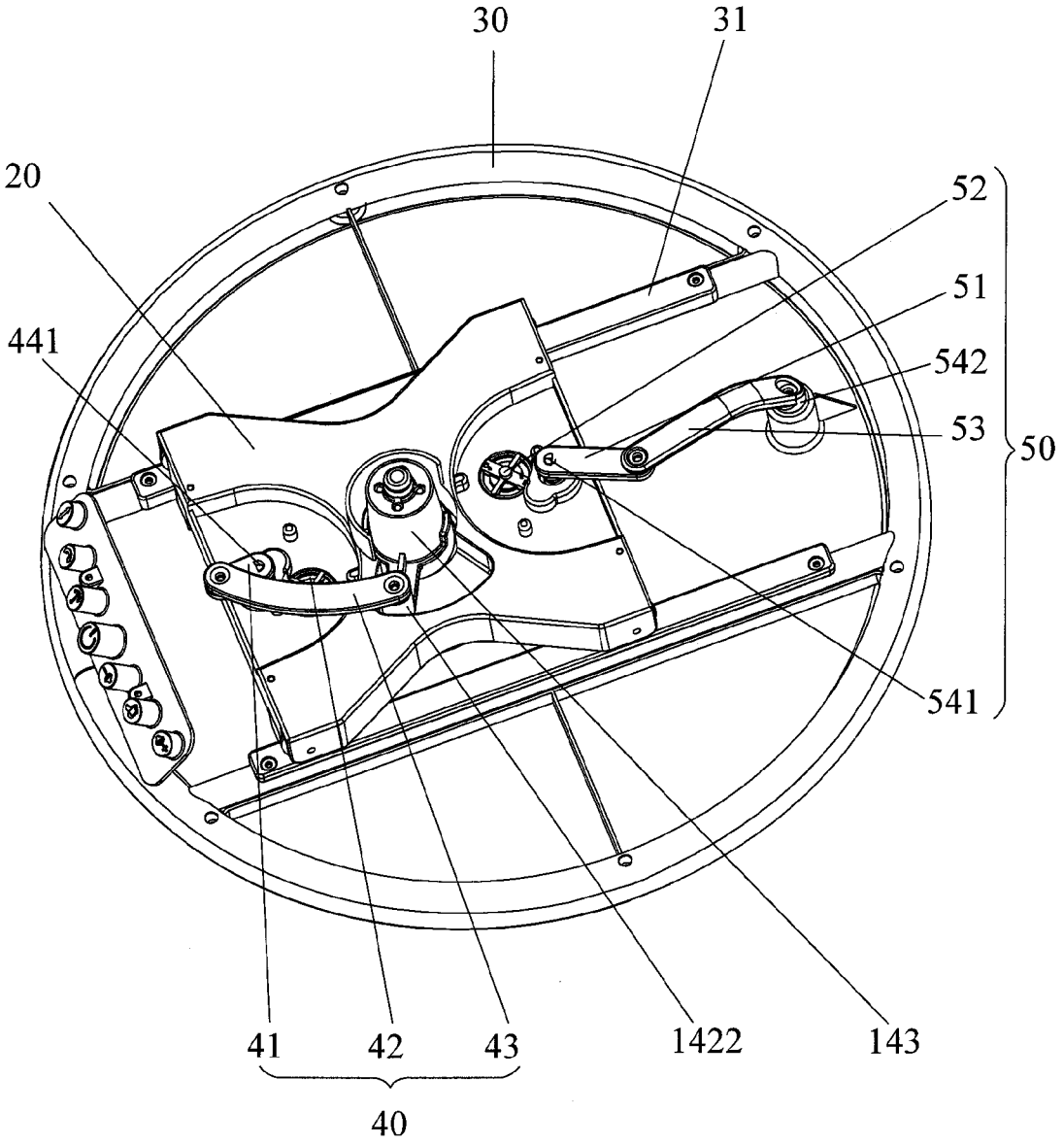
Figure 13:
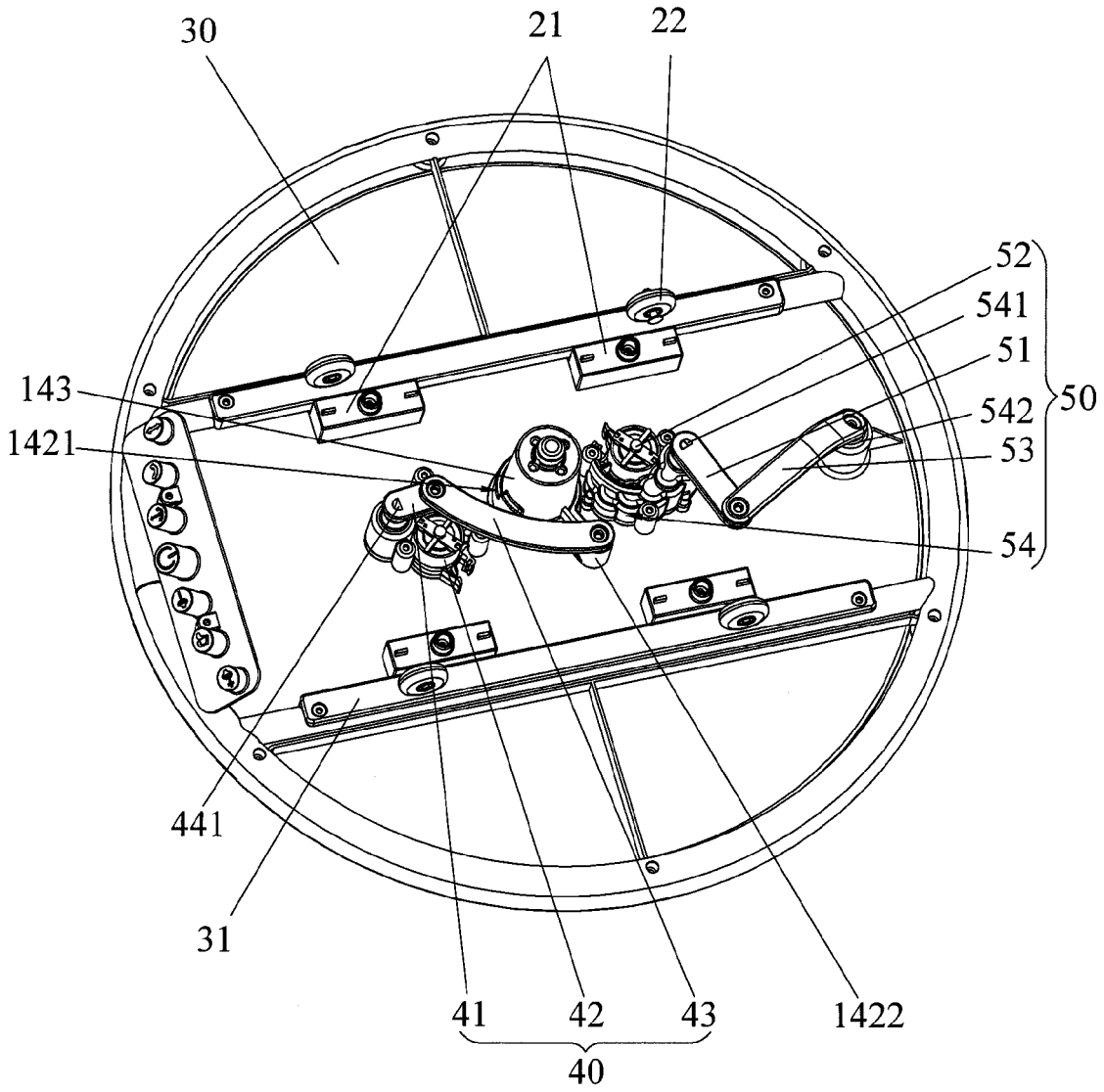
FIG. 13 is a schematic view illustrating the construction of the rotation drive mechanism and the sliding drive mechanism, the representation of the movable platform being partially omitted in FIG. 13.

As described previously, the rotation drive mechanism 40 can drive the seat portion 10 to rotationally oscillate about the pivot axis X relative to the support base 30 and the movable platform 20, whereas the sliding drive mechanism 50 can drive all of the seat portion 10, the coupling mount 14 and the movable platform 20 to slide back and forth along a substantially horizontal plane relative to the support base 30. Each of the rotation drive mechanism 40 and the sliding drive mechanism 50 can operate alone, or both the rotation drive mechanism 40 and the sliding drive mechanism 50 can operate in parallel to create a combination of back and forth sliding displacement with a reciprocated rotation about the pivot axis X. FIGS. 12 and 13 are schematic views exemplary illustrating intermediate states of the rotation drive mechanism 40 and the sliding drive mechanism 50 operated in parallel.

Most of the moving components in the rotation drive mechanism 40 (including the crank 41 and the linking rod 43) and most of the moving components in the sliding drive mechanism 50 (including the crank 51 and the linking rod 53) move in substantially parallel and horizontal planes, which can advantageously reduce the assembly space in the support base 30.

Figure 6:
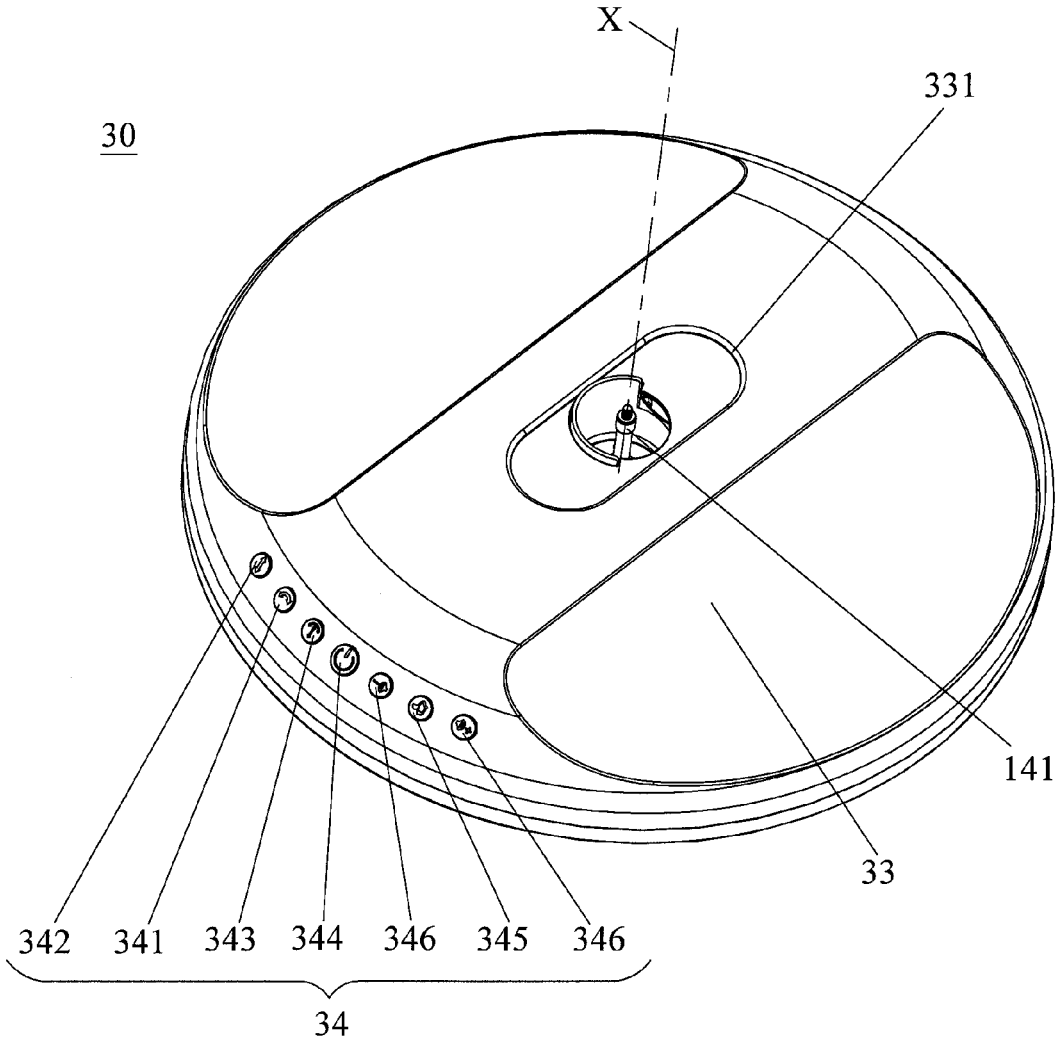
FIG. 6 is a schematic view illustrating a support base of the infant chair apparatus shown in FIG. 1.

Referring to FIGS. 1 and 6, the support base 30 can further include a control interface 34 that can be used to control the operation of the rotation drive mechanism 40 and the sliding drive mechanism 50. For example, the control interface 34 can include a control button 341 operable to activate the rotation drive mechanism 40 alone, a control button 342 operable to activate the sliding drive mechanism 50 alone, and a control button 343 operable to activate both the rotation drive mechanism 40 and the sliding drive mechanism 50 in parallel. When the control button 341 is depressed, a first mode of operation can be activated so that the seat portion 10 only rotates about the pivot axis X in a reciprocated manner. When the control button 342 is depressed, a second mode of operation can be activated so that the seat portion 10 only slides back and forth along the rails 31. When the control button 343 is depressed, a third mode of operation can be activated so that the seat portion 10 performs a combination of reciprocated rotation about the pivot axis X, and back and forth sliding displacement along the rails 31.

It is understood that the control interface 34 may include other functional buttons for controlling various functions of the infant chair apparatus 1, such as a power button 344, a play button 345 for playing music, and a sound volume button 346.

Referring to FIG. 6, the support base 30 can include an outer housing 33 in which are arranged the movable platform 20, the rotation drive mechanism 40 and the sliding drive mechanism 50. The outer housing 33 can have an opening 331 of an elongated shape for passage of the coupling mount 14. When the movable platform 20 slides relative to the support base 30, the coupling mount 14 can moves along the opening 331.

Figure 7:
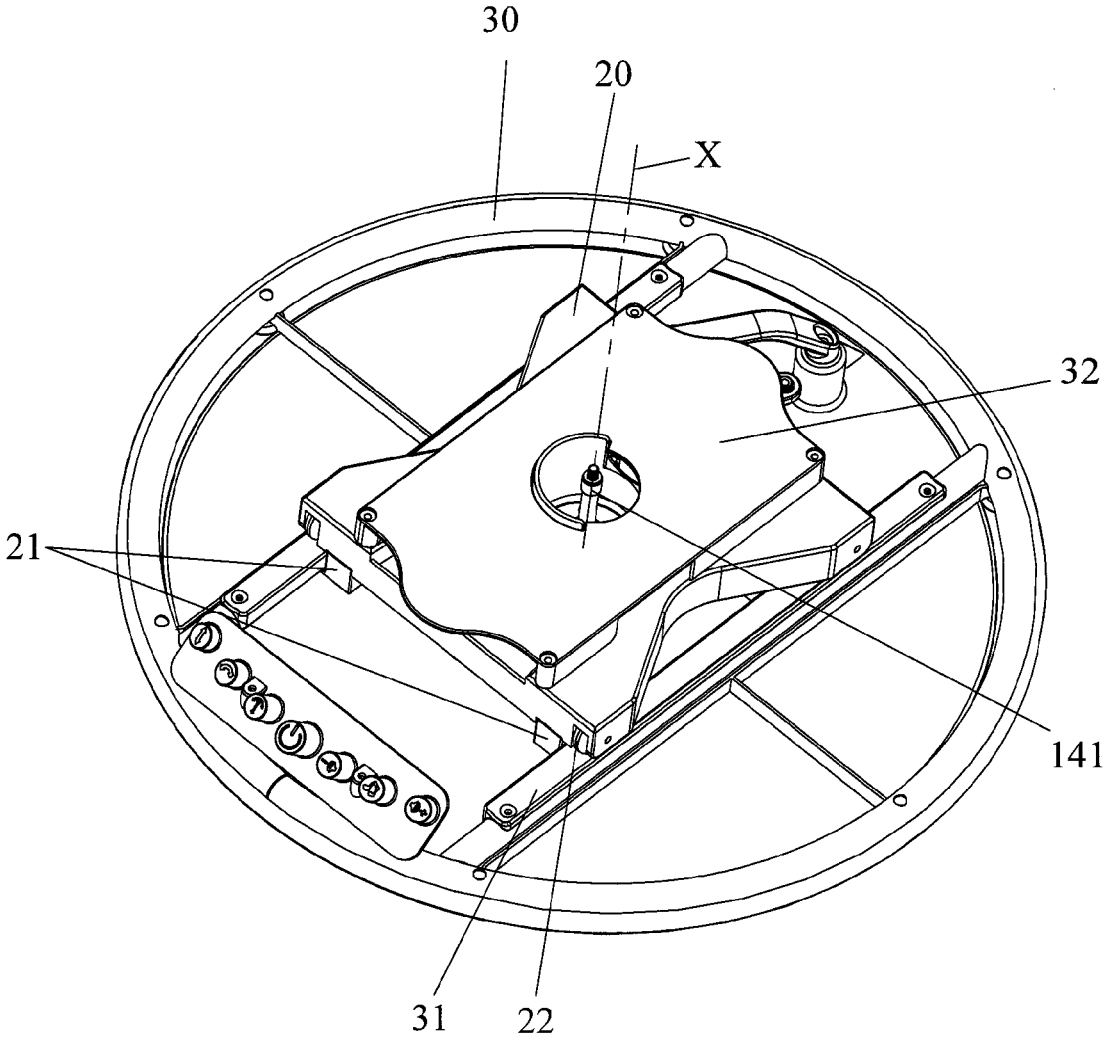
FIG. 7 is a schematic view illustrating a movable platform assembled in the support base.
Figure 8:
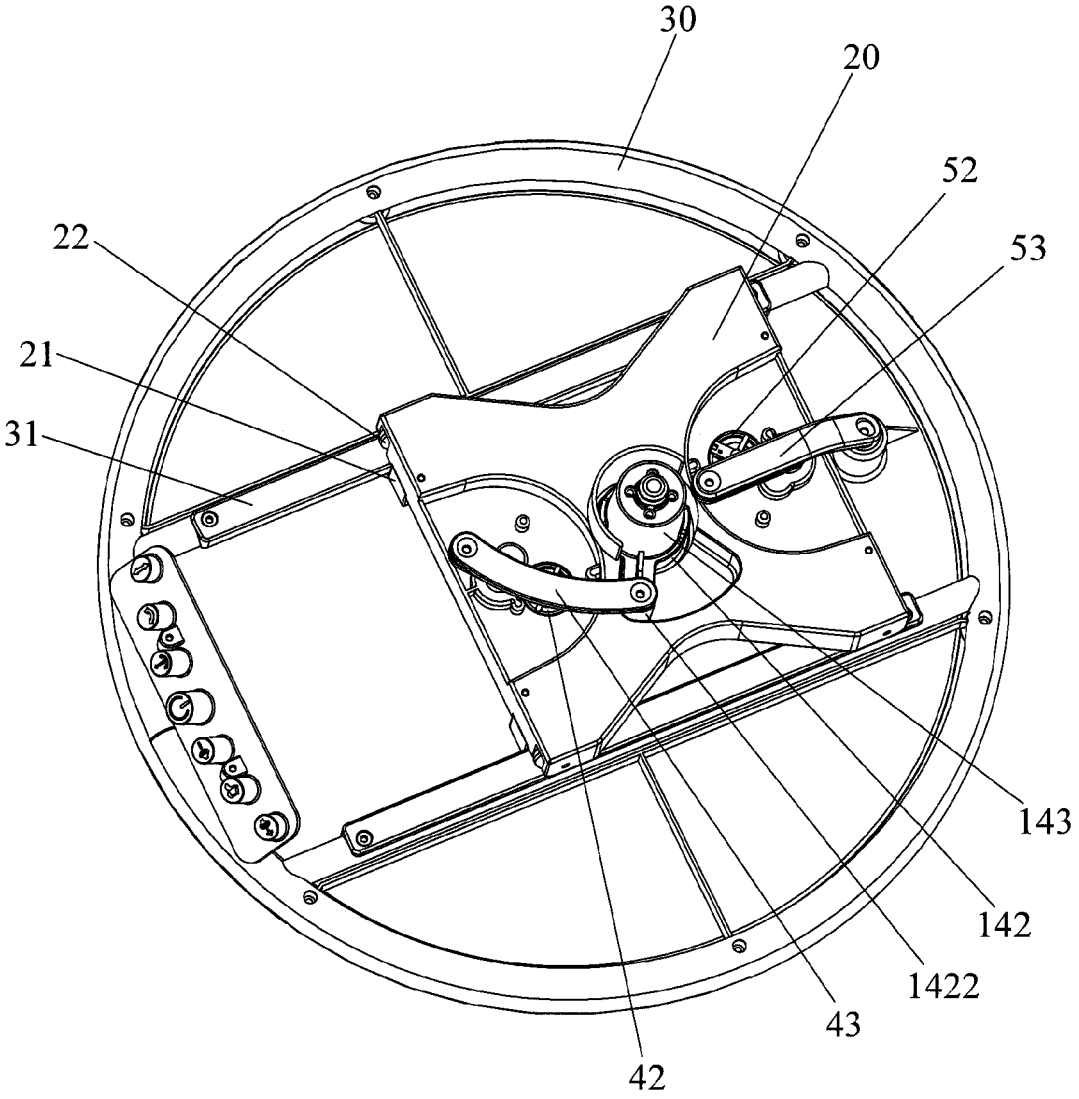
FIG. 8 is a schematic view illustrating the assembly of a rotation drive mechanism and a sliding drive mechanism in the support base.
Figure 9:
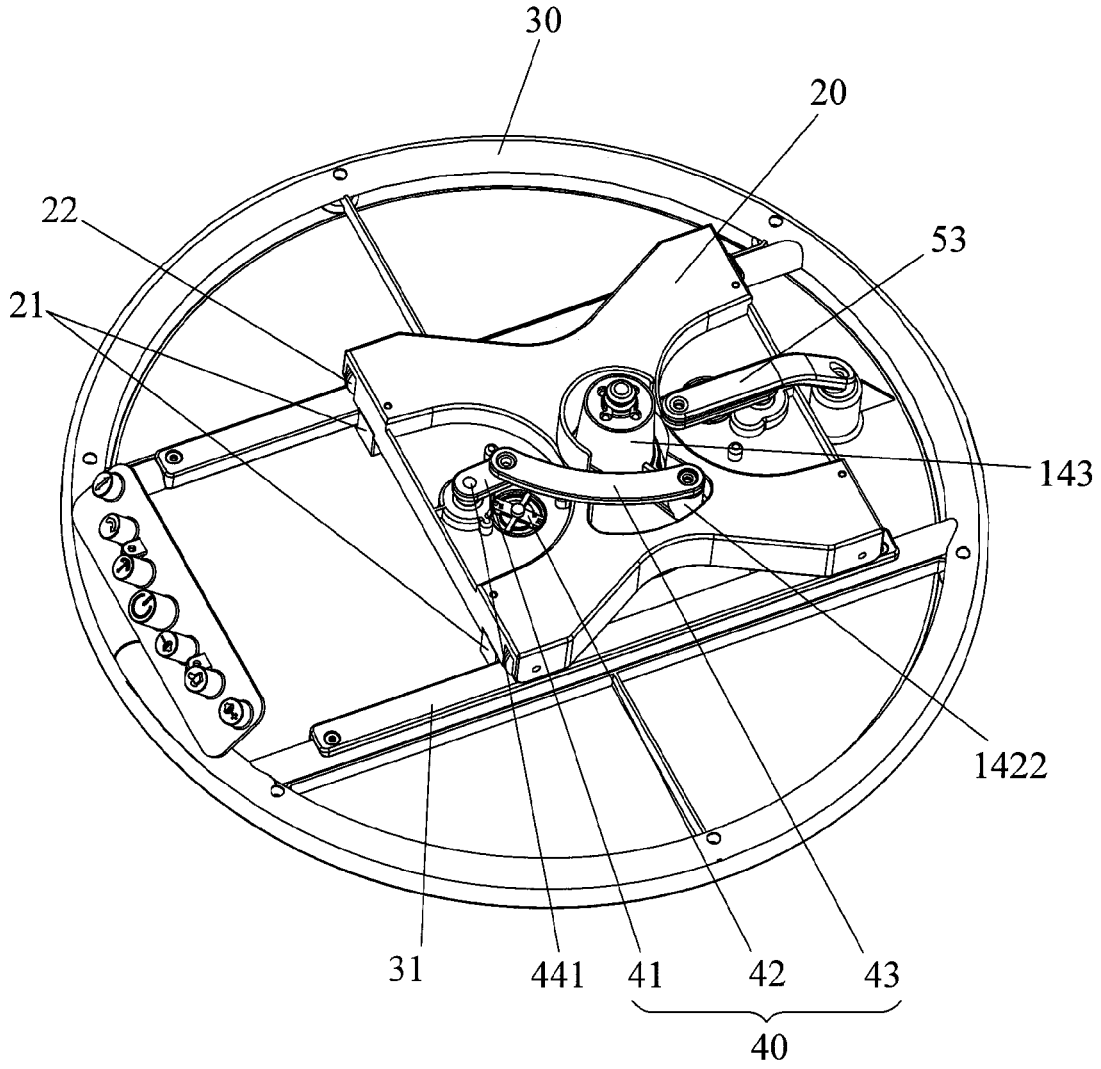
FIGS. 9-12 are schematic views illustrating various intermediate states of the movable platform, the rotation drive mechanism and the sliding drive mechanism.

Referring to FIG. 7, the movable platform 20 can be affixed with an upper cover 32 that conceals at least partially the rotation drive mechanism 40 and the sliding drive mechanism 50 below the opening 331. Accordingly, moving components of the rotation drive mechanism 40 and the sliding drive mechanism 50 (e.g., the cranks 41, 51 and linking rods 43, 53) will not be exposed through the opening 331 of the outer housing 33, which can improve safety of the infant chair apparatus 1.

Advantages of the infant chair apparatuses described herein include the ability to impart different soothing displacements to a seat portion according to the preference of a child placed on the seat portion. All of the soothing displacements can be substantially horizontal, which can prevent sickness that may be felt by certain children when subject to vertical displacements.

Realizations of the infant chair apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant chair apparatus comprising:

a support base;

a movable platform assembled with the support base for sliding movement, the movable platform including an axle affixed therewith that extends upright, and a stem pivotally connected with the axle;

a seat portion arranged above the support base and fastened to the stem, thereby the seat portion being pivotally connected with the movable platform;

a rotation drive mechanism respectively connected with the stem and the movable platform and operable to drive reciprocated rotation of the seat portion relative to the movable platform, the rotation drive mechanism including a first electric motor, and a linking rod respectively coupled with the first electric motor and the stem, operation of the first electric motor driving movement of the linking rod that causes rotation of the stem and the seat portion about the axle; and a sliding drive mechanism respectively connected with the movable platform and the support base, the sliding drive mechanism including a second electric motor operable to drive the movable platform to slide relative to the support base.

2. The infant chair apparatus according to claim 1, wherein the seat portion includes a seat frame that is detachably fastened to the stem vertically above the axle.

3. The infant chair apparatus according to claim 2, wherein an underside of the seat frame is affixed with a sleeve in which the stem is at least partially received.

4. The infant chair apparatus according to claim 3, wherein a lower rim of the sleeve is formed with at least one flange protruding downward, and a lower portion of the stem has at least one slot into which the flange correspondingly engages, the engagement of the flange with the slot rotationally coupling the seat portion with the stem.

5. The infant chair apparatus according to claim 3, wherein the seat portion includes a latch, the stem has an upper end formed with a stud having a recess, and the latch engages with the recess of the stud when the stem is assembled through an interior of the sleeve.

6. The infant chair apparatus according to claim 5, wherein the latch is further connected with a release actuator operable to cause the latch to disengage from the recess.

7. The infant chair apparatus according to claim 5, wherein the latch is spring biased to engage with the stud.

8. The infant chair apparatus according to claim 1, wherein the linking rod of the rotation drive mechanism is connected with a lower portion of the stem.

9. The infant chair apparatus according to claim 1, wherein the rotation drive mechanism further includes a crank affixed with a rotary shaft that is driven in rotation by the first electric motor, and the linking rod has two opposite ends respectively connected pivotally with the crank and the stem.

10. The infant chair apparatus according to claim 9, wherein the rotation drive mechanism further includes a speed reduction mechanism comprised of a train of transmission gears connected with the first electric motor and the rotary shaft.

11. The infant chair apparatus according to claim 1, wherein the seat portion is rotatable within an angular range of about 20 degrees to about 80 degrees.

12. The infant chair apparatus according to claim 1, wherein the sliding drive mechanism further includes a second crank affixed with a second rotary shaft that is driven in rotation by the second electric motor, and a second linking rod having two opposite ends respectively connected pivotally with the second crank and an anchor point of the support base.

13. The infant chair apparatus according to claim 12, wherein the sliding drive mechanism further includes a second speed reduction mechanism comprised of a train of second transmission gears connected with the second electric motor and the second rotary shaft.

14. The infant chair apparatus according to claim 1, wherein the second electric motor is carried by the movable platform.

15. The infant chair apparatus according to claim 1, wherein the movable platform is operable to slide along a substantially horizontal plane, and the seat portion is rotatable about a pivot axis that is substantially perpendicular to the plane along which the movable platform slides.

16. An infant chair apparatus comprising:

a support base;

a movable platform assembled with the support base for sliding movement, the movable platform including an axle affixed therewith that extends upright, and a stem pivotally connected with the axle;

a seat portion arranged above the support base, the seat portion being positioned above the axle and fastened to the stem;

a rotation drive mechanism operable to drive reciprocated rotation of the seat portion relative to the movable platform, wherein the rotation drive mechanism includes a first electric motor, a first crank driven in rotation by the first electric motor, and a first linking rod respectively connected with the first crank and the stem; and a sliding drive mechanism operable to drive the movable platform to slide relative to the support base, wherein the sliding drive mechanism includes a second electric motor, a second crank driven in rotation by the second electric motor, and a second linking rod respectively connected with the second crank and an anchor point of the support base.

17. The infant chair apparatus according to claim 16, wherein the first and second electric motors are carried by the movable platform.

18. The infant chair apparatus according to claim 16, wherein an underside of the seat portion is affixed with a sleeve to which the stem is detachably fastened.

19. The infant chair apparatus according to claim 18, wherein a lower rim of the sleeve is formed with at least one flange protruding downward, and a lower portion of the stem has at least one slot into which the flange correspondingly engages, the engagement of the flange with the slot rotationally coupling the seat portion with the stem.

20. The infant chair apparatus according to claim 18, wherein the seat portion includes a latch, the stem has an upper end formed with a stud having a recess, and the latch engages with the recess of the stud when the stem is assembled through an interior of the sleeve.

21. The infant chair apparatus according to claim 20, wherein the latch is further connected with a release actuator operable to cause the latch to disengage from the recess.

* * * * *